US008232896B2

(12) United States Patent
Keller

(10) Patent No.: US 8,232,896 B2
(45) Date of Patent: Jul. 31, 2012

(54) PEDESTRIAN SIGNAL HOUSING WITH INFORMATION DISPLAY

(76) Inventor: Gary Keller, San Clemente, CA (US)

( * ) Notice: Subject to any disclaimer, the term of this patent is extended or adjusted under 35 U.S.C. 154(b) by 420 days.

(21) Appl. No.: 12/635,500

(22) Filed: Dec. 10, 2009

(65) Prior Publication Data

US 2011/0140923 A1 Jun. 16, 2011

(51) Int. Cl.
*G08G 1/095* (2006.01)

(52) U.S. Cl. ..... 340/944; 340/907; 340/917; 340/927; 340/10.4; 340/555; 40/541; 40/553; 40/557

(58) Field of Classification Search ..... 340/944, 340/907, 917, 927, 10.4, 555; 40/541, 553, 40/557

See application file for complete search history.

(56) References Cited

U.S. PATENT DOCUMENTS

| | | | | |
|---|---|---|---|---|
| 2,503,574 | A | 4/1950 | Allen | |
| 5,150,116 | A | 9/1992 | West | |
| 5,654,705 | A | 8/1997 | Houten et al. | |
| 6,460,495 | B1 * | 10/2002 | Seitz et al. | 123/90.16 |
| 6,473,002 | B1 * | 10/2002 | Hutchison | 340/944 |
| 6,539,656 | B2 | 4/2003 | Maas et al. | |
| 7,167,106 | B2 | 1/2007 | Haase | |
| 7,375,650 | B2 | 5/2008 | Lo | |
| 7,384,171 | B2 | 6/2008 | Schoning | |
| 7,394,351 | B2 | 7/2008 | Solow | |
| 7,443,315 | B2 | 10/2008 | Lo | |
| 8,081,087 | B2 * | 12/2011 | Jones | 340/907 |
| 2006/0119535 | A1 | 6/2006 | Van Fossan | |
| 2007/0008178 | A1 | 1/2007 | Lo | |
| 2007/0257817 | A1 | 11/2007 | Mahoney | |
| 2008/0304641 | A1 | 12/2008 | Rowe et al. | |
| 2009/0201432 | A1 | 8/2009 | Hyde et al. | |

OTHER PUBLICATIONS

Street Advertising: Bench Advertising, Bus Stop Advertising, Street Furniture Displays. CBS Outdoor. Sep. 8, 2009. <http://www.cbsoutdoor.com/media/streetfurniture.com> 2 pages.

LED Traffic Business Since 1996. EOI Your Reliable Partner. Incandescent Look Pedestrian Countdown Signal. Copyright 2007. Excellence Opto, Inc. 2 pages.

Pedestrian Signal Housing. McCain, Inc. Copyright 2009. Updated Feb. 12, 2009. 2 pages.

* cited by examiner

*Primary Examiner* — Tai T Nguyen
(74) *Attorney, Agent, or Firm* — Stetina Brunda Garred & Brucker

(57) ABSTRACT

A traditional pedestrian signal housing with a video display screen mounted to a pedestrian side of the traditional pedestrian signal housing is disclosed. The video display screen is mounted to the pedestrian side of the pedestrian signal housing by way of a face plate. Tunnel visors may be attached to the traditional pedestrian signal housing to prevent cross traffic from being distracted by the visual images displayed on the video display screen. The information displayed on the video display screen may be advertisements, information, directions, etc. Local or national entities may pay for advertisements to generate revenues for the cities or governmental entities.

12 Claims, 6 Drawing Sheets

30
22
10b
46b
20
18
10a
52
12
46a
14
50a
16

PEDESTRIAN SIGNAL HOUSING WITH INFORMATION DISPLAY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to pedestrian signal housings for relaying information (e.g., advertisements, directions, etc.) to pedestrians while waiting to cross a crosswalk.

Cities typically take in advertising revenues by allowing businesses to place advertisements on city controlled property. By way of example and not limitation, bus shelters may have a poster advertising a particular movie, restaurant or other service or product. These posters are provided to the city (or a third party working in conjunction with the city) by businesses that desire to advertise within that city. In exchange for allowing the business to advertise on city property, the city collects advertising revenues from the business. The advertising revenues help to pay for various city functions.

Other venues for advertisement revenues have also been considered. By way of example and not limitation, bus seats, vending machines, bus shelters, newsstands, trash receptacles, public toilets, benches, display kiosks, interactive street furniture, other site amenities, etc.

Accordingly, there is a need in the art for providing additional venues to raise advertising revenues.

BRIEF SUMMARY

The pedestrian signal housing with information display addresses the needs discussed above, discussed below and those that are known in the art.

The pedestrian signal housing may be a housing that has already been approved by the governmental agencies designated by the government to ensure that public pedestrian signal housing is safe. For example, Federal Highway Administration (FHWA), National Highway Traffic Safety Administration (NHTSA), Department of Transportation (DOT) for each of the fifty (50) states, all D.O.T.s for North America, South America, continents of Europe, Asia, Africa and Australia. These preapproved pedestrian signal housing may be manufactured in accordance with the relevant specification (e.g., Manual of Uniform Traffic Control devices) of the appropriate entity. These preapproved pedestrian signal housings may be retrofitted with a video display screen and/or speaker to project visual and/or audio signals to pedestrians waiting to cross a crosswalk. In particular, the pedestrian signal housing defines a street side and a pedestrian side. On the street side of the pedestrian signal housing, the pedestrian signal housing may display a lightable walk indicia (e.g., WALK, walking man, etc.) and a lightable stop indicia (e.g., STOP, red hand, etc.). On the pedestrian side of the pedestrian signal housing, typically, no electronics are displayed. The video display screen and/or the speaker may be mounted to the pedestrian side of the pedestrian signal housing by way of a faceplate. In particular, the faceplate secures the video display screen and/or the speaker to the pedestrian side of the pedestrian signal housing. The faceplate may additionally have a transparent window that is weather proof and scratch resistant to withstand weather conditions and vandalism. In use, the pedestrian signal housing with information display may be installed on both sides of a crosswalk. As a pedestrian walks up to the crosswalk, the pedestrian signal housing on the far side of the crosswalk may instruct the pedestrian to wait by activating the lightable stop indicia. As the person waits, the video display screen and/or the speaker mounted to the pedestrian signal housing closest to the pedestrian may project visual and/or audible signals to the waiting pedestrian. By way of example and not limitation, the video display screen and/or speaker may project local information, global information, directions, etc. to the waiting pedestrian. The waiting pedestrian is a captive audience. Local and national businesses may purchase advertising time to relay information to waiting pedestrians. The revenues generated may be provided to the city, state and other governmental entities to assist in running the governmental functions.

Based on the demographics of the local area, the advertisers may purchase advertising time at one or more different crosswalks based on the target market of the advertiser.

More particularly, a pedestrian traffic control system disposed between first and second sidewalks is disclosed. The system may comprise first and second pedestrian signals.

The first pedestrian light signal may be disposed at the first sidewalk for directing pedestrian traffic from the second sidewalk to the first sidewalk and for displaying information to pedestrians waiting at the first sidewalk to cross over to the second sidewalk.

The first traditional pedestrian light signal may comprise a first housing and a first video screen. The first housing may define a street side and an opposed pedestrian side. The street side of the first housing may have a lightable walk indicia and a lightable stop indicia. The lightable walk indicia may be lighted or activated for a first period of time to direct pedestrians to cross from the second sidewalk to the first sidewalk. The lightable stop indicia may be lighted or activated for a second period of time to direct pedestrians to wait at the second sidewalk until safe. The first video screen may be disposed on the pedestrian side of the first housing to display information to pedestrians waiting at the first sidewalk to cross over to the second sidewalk.

The second pedestrian light signal may be disposed at the second sidewalk for directing pedestrian traffic from the first sidewalk to the second sidewalk and for displaying information to pedestrians waiting at the second sidewalk to cross over to the first sidewalk. The second traditional pedestrian light signal may comprise a second housing and a second video screen. The second housing may define a street side and an opposed pedestrian side. The street side of the second housing may have a lightable walk indicia and a lightable stop indicia. The lightable walk indicia may be lighted or activated for a third period of time to direct pedestrians to cross from the first sidewalk to the second sidewalk. The lightable stop indicia may be lighted or activated for a fourth period of time to direct pedestrians waiting at the first sidewalk until safe. The second video screen may be disposed on the pedestrian side of the second housing to display information to pedestrians waiting at the second sidewalk while waiting to cross over to the first sidewalk.

The pedestrian traffic control system may further comprise a first speaker disposed adjacent (e.g., within, exterior to, etc.) the first housing for projecting audio in sync with video displayed on the first video screen to pedestrians waiting at the first sidewalk. A computer may sync the information displayed on the first video screen to the lightable stop indicia of the second pedestrian signal. The computer may also sync the information displayed on the second video screen to the lightable stop indicia of the first pedestrian signal.

The pedestrian traffic control system may further comprise a first sensor, a second sensor and a computer. The first sensor may be disposed at the first sidewalk and in communication with the first video screen. The second sensor may be disposed at the second sidewalk and in communication with the second video screen. The computer may control the first and second video screens. The computer may control the information to be displayed on the first video screen so as to be initiated when a first pedestrian triggers the first sensor. Also, the computer may control the information to be displayed on the second video screen so as to be initiated when a second pedestrian triggers the second sensor. The first and second sensors may be a push button switch or a motion sensor.

The computer may control the information displayed on the first video screen so as to terminate before or at the time the lightable stop indicia of the second pedestrian light signal is deactivated. Also, the computer may control the information displayed on the second video screen so as to terminate before or at the time the lightable stop indicia of the first pedestrian light signal is deactivated.

The information may be local advertisements, directions or safety information.

The first and second pedestrian traffic signals may further comprise first and second tunnel visors attached to the pedestrian side of the first and second pedestrian traffic signals.

Additionally, a method of safely displaying information to pedestrians waiting to cross a pathway disposed between first and second sidewalks is disclosed. The method may comprise the steps of activating a lightable stop indicia of a second pedestrian light signal disposed at the second sidewalk; upon activation of the lightable stop indicia of the second pedestrian light signal, activating a first video screen of a first pedestrian light signal disposed at the first sidewalk so that pedestrians at the first sidewalk waiting to cross the pathway to the second sidewalk can view information displayed on the first video screen; activating a lightable stop indicia of a first pedestrian light signal disposed at the first sidewalk; and upon activation of the lightable stop indicia of the first pedestrian light signal, activating a second video screen of a second pedestrian light signal disposed at the second sidewalk so that pedestrians at the second sidewalk waiting to cross the pathway to the first sidewalk can view information displayed on the second video screen.

The method may further comprise the steps of synching deactivation of the lightable stop indicia of the second pedestrian signal and the first video screen; and synching deactivation of the lightable stop indicia of the first pedestrian signal and the second video screen. The synching steps may comprise the steps of deactivating the lightable stop indicia of the second pedestrian signal; before or upon deactivating the lightable stop indicia of the second pedestrian signal, deactivating the first video screen; deactivating the lightable stop indicia of the first pedestrian signal; and before or upon deactivating the lightable stop indicia of the first pedestrian signal, deactivating the second video screen.

The activating the first and second video screens step may comprise the steps of triggering a first push button or a first motion sensor associated with the first pedestrian signal; upon triggering the first push button or first motion sensor, activating the first video screen; triggering a second push button or a second motion sensor associated with the second pedestrian signal; and upon triggering the second push button or second motion sensor, activating the second video screen.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
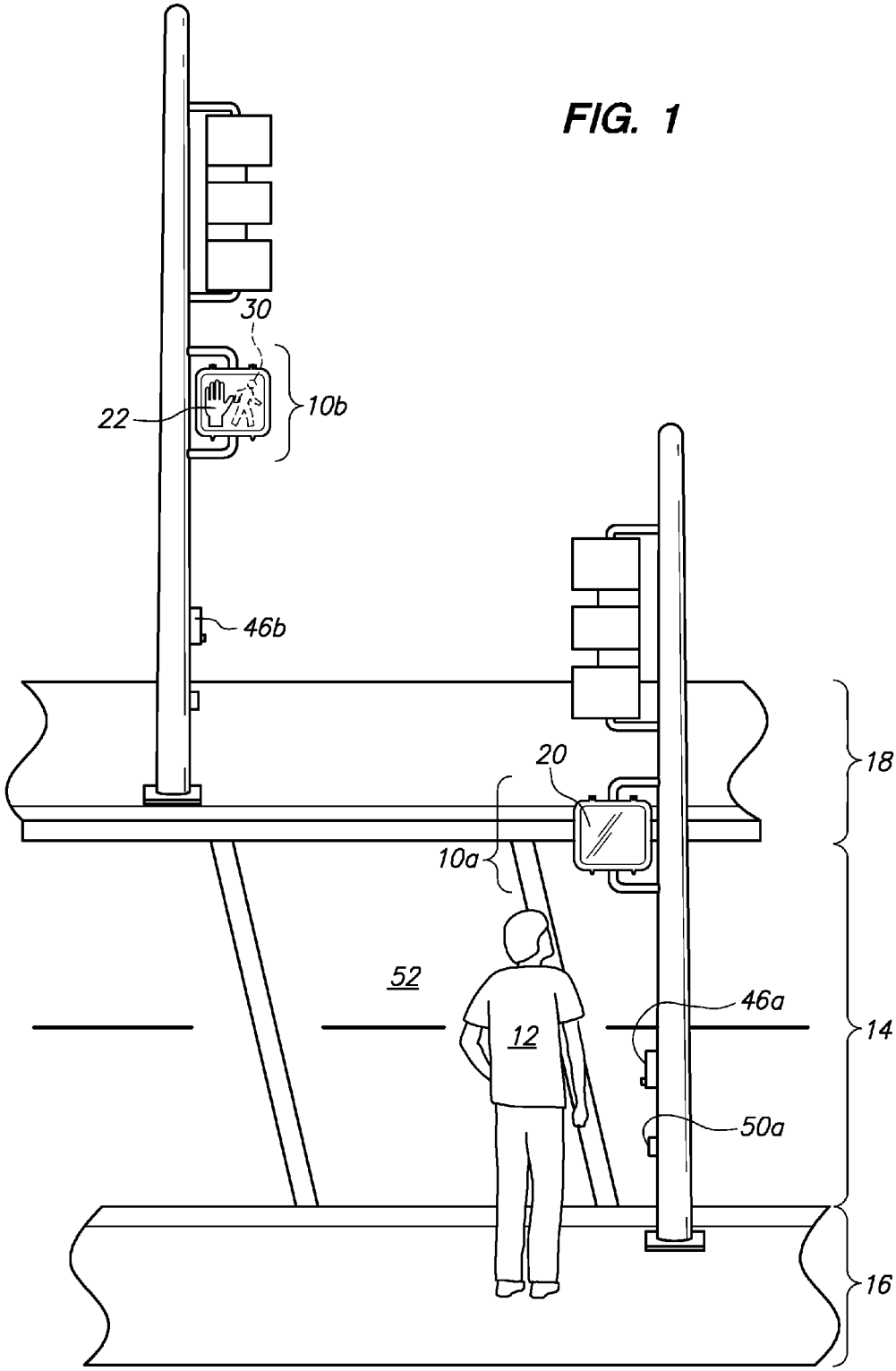
FIG. 1 is a perspective view of a pedestrian viewing information displayed on a video display screen attached to a pedestrian side of a pedestrian signal while waiting to cross a crosswalk.
Figure 2:
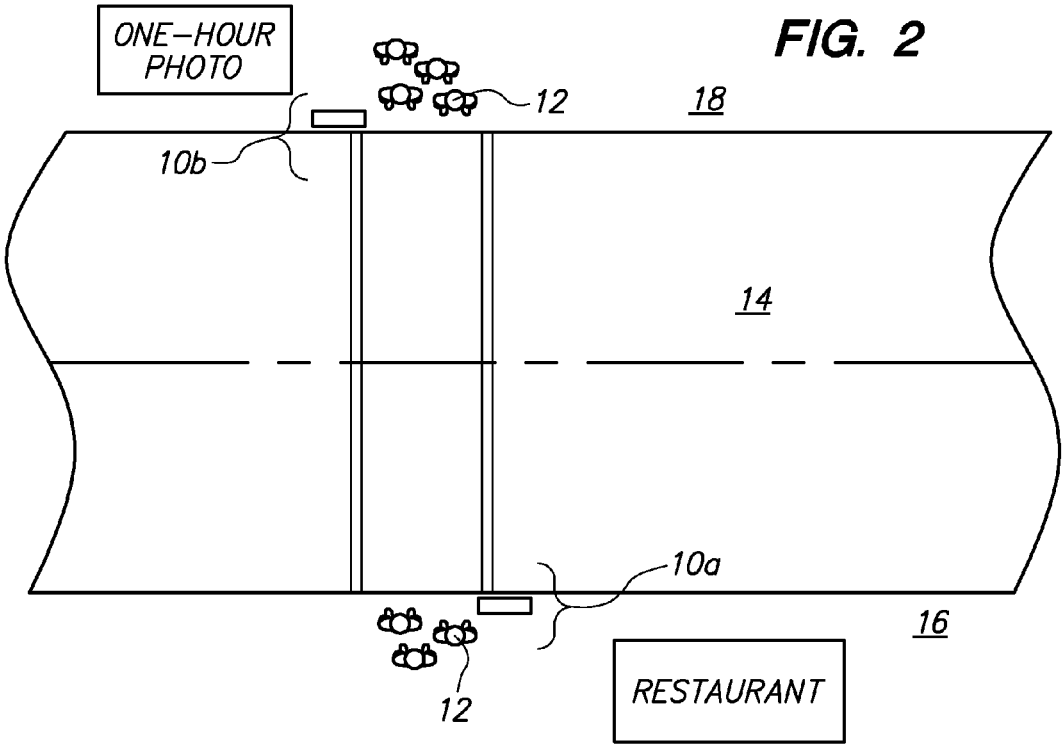
FIG. 2 is a top view of FIG. 1.

Referring now to FIG. 1, traditional pedestrian signals 10*a, b* are shown. As a pedestrian 12 waits to cross a pathway 14 from a first sidewalk 16 to a second sidewalk 18, the pedestrian signal 10*a* on the first sidewalk 16 or the sidewalk where the pedestrian 12 is waiting to cross the pathway 14 may view information on a video display screen 20 of the pedestrian signal 10*a* located at the first sidewalk 16. The information displayed on the video display screen 20 of the pedestrian signal 10*a* may provide information to the pedestrian 12 regarding local information such as one hour photo services located adjacent the second sidewalk 18, as shown in FIG. 2. Additionally, pedestrians 12 at the second sidewalk 18 may learn of information via a video display screen 20 on the pedestrian signal 10*b* regarding local services at the other side or the first sidewalk 16 such as restaurant services. The information provided on the video display screens 20 of the pedestrian signals 10*a, b* may be displayed only when a lightable stop indicia 22 (e.g., hand signal; see FIG. 1) is activated or lighted on the other pedestrian signal 10*b*, a. By way of example and not limitation, information may only be displayed on the video display screen 20 of the pedestrian signal 10*b* only when the lightable stop indicia 22 is activated on the pedestrian signal 10*a*, and vice versa. As such, such configuration provides specific local information to pedestrians 12 while the pedestrian 12 is waiting. This provides a safe and efficient means of relaying information to pedestrians 12, a captive audience.

Figure 3:
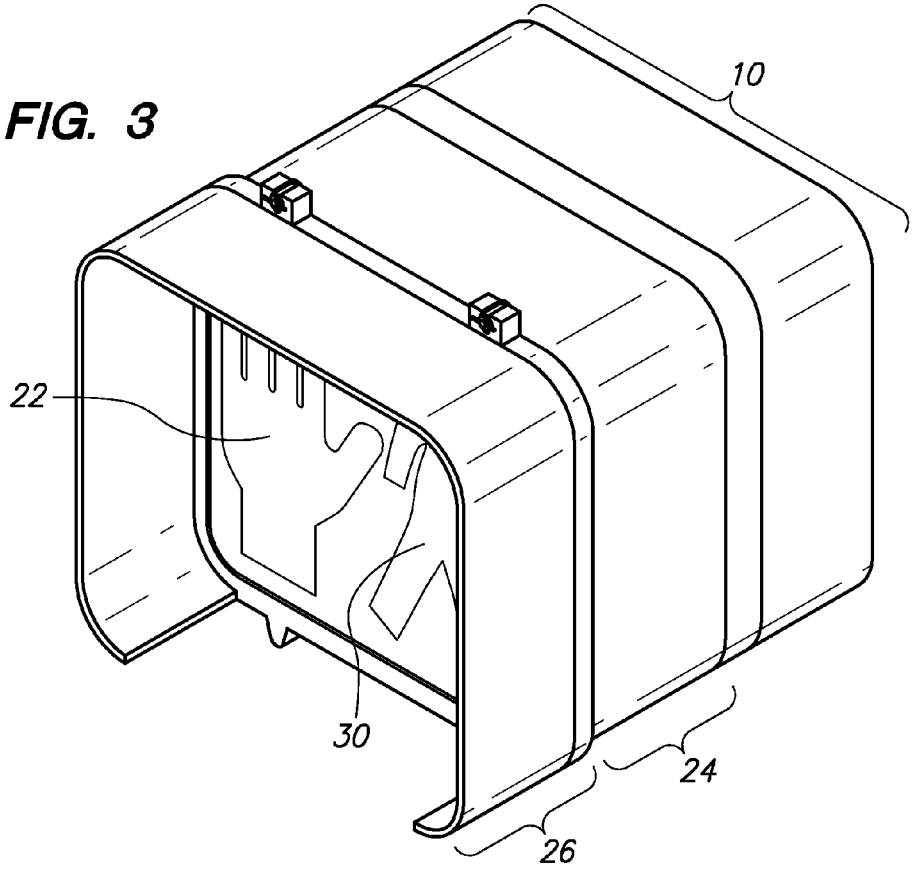
FIG. 3 is a perspective view of the pedestrian signal showing a street side of the pedestrian signal.
Figure 4:
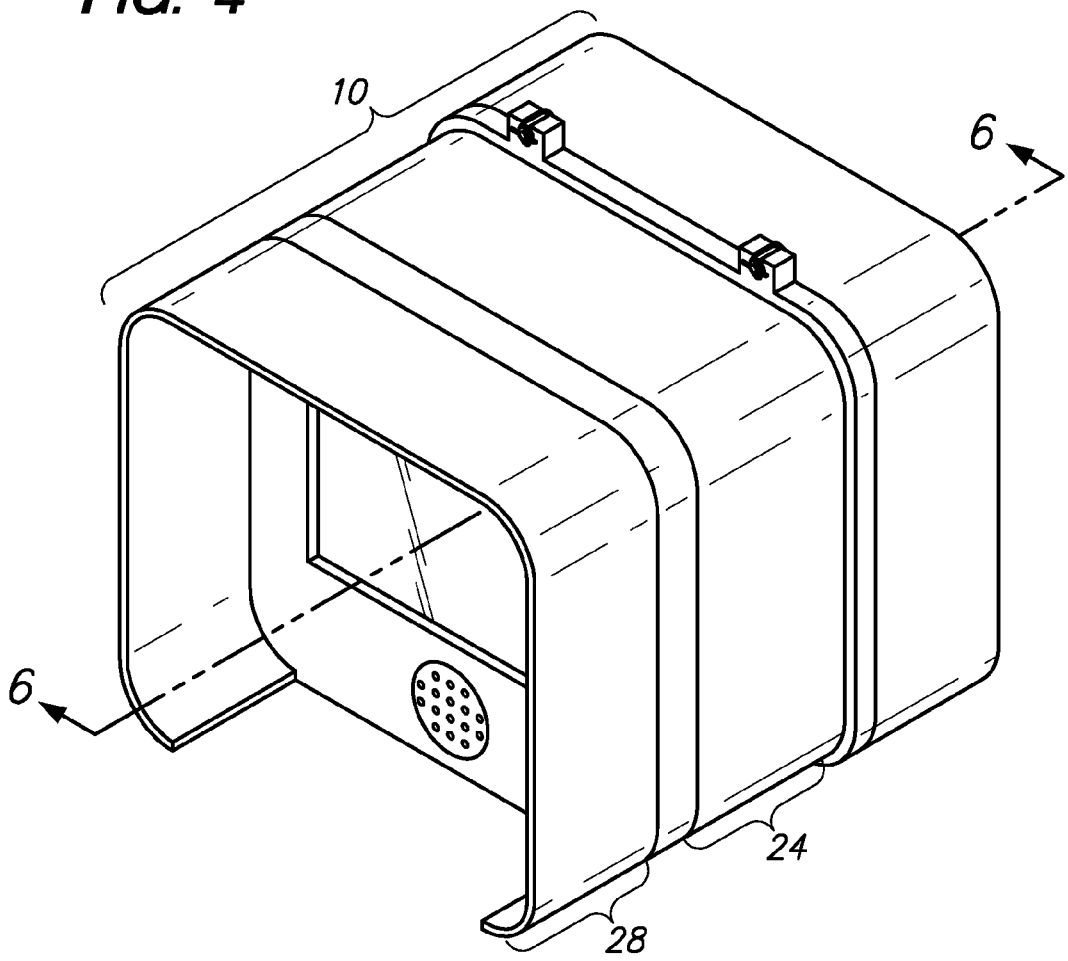
FIG. 4 is a perspective view of the pedestrian signal and illustrating the pedestrian side of the pedestrian signal.

More particularly, referring now to FIGS. 3 and 4, the pedestrian signal 10 may comprise a pedestrian signal housing 24 and an optional tunnel visor 26 disposed on a street side (see FIG. 3) of the pedestrian housing 24 and an optional tunnel visor 28 disposed on a pedestrian side (see FIG. 4) of the pedestrian signal housing 24. The tunnel visors 26, 28 mitigate driver distractions that might be caused by activation of the lightable stop indicia 22/lightable walk indicia 30 on the street side of the housing 24 or information displayed on the video display screen 20 on the pedestrian side of the housing 24 of the pedestrian signal 10. The tunnel visors 26, 28 may extend from the outer periphery of the housing 24 such that the lightable stop indicia 22, lightable walk indicia 30 and the video display screen 20 are primarily viewable by pedestrians on the first and second sidewalks 16, 18 while waiting to cross the pathway 14 and not by automobile drivers in cross traffic on the pathway 14.

Figure 5:
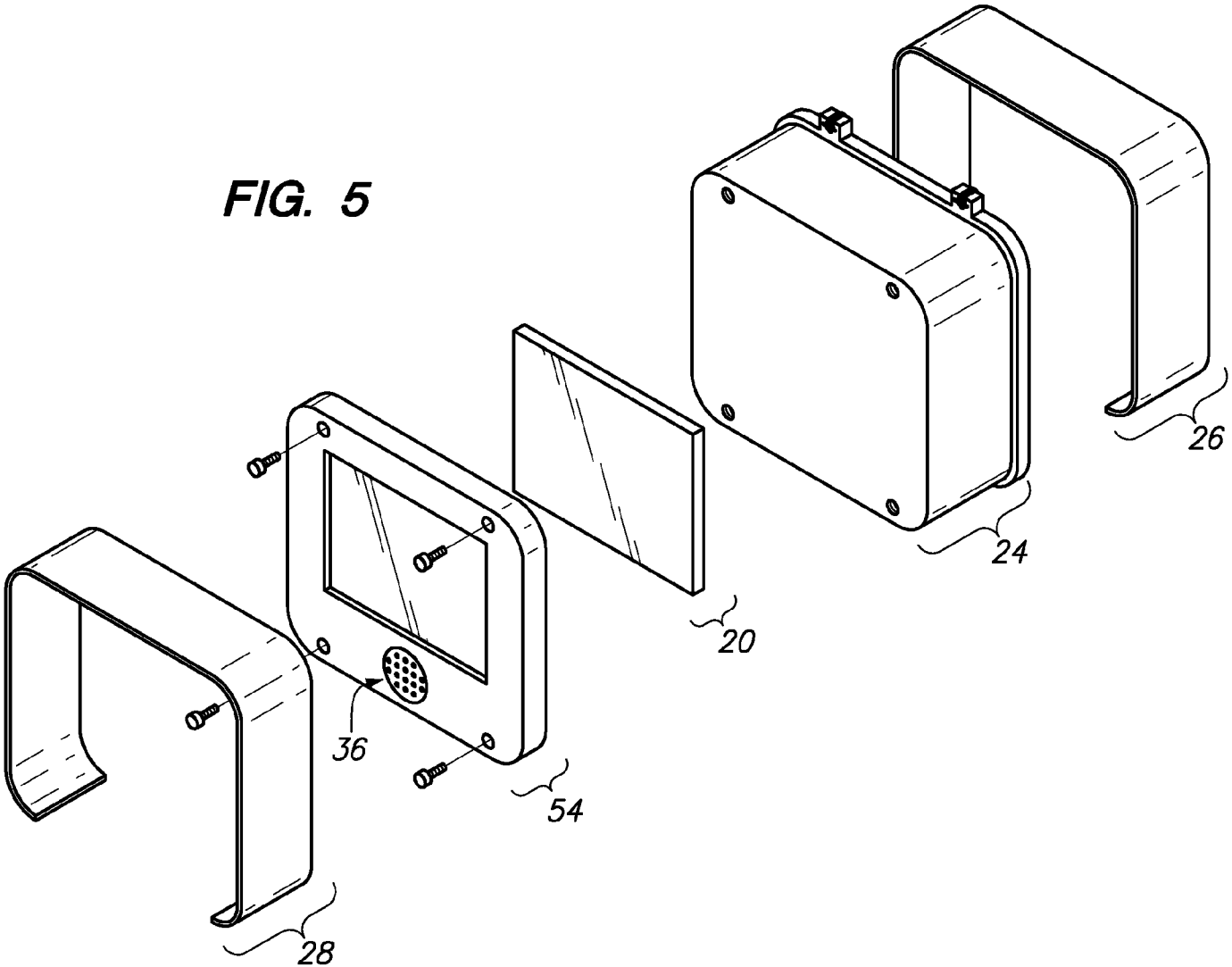
FIG. 5 is an exploded perspective view of the pedestrian signal shown in FIG. 4.
Figure 6:
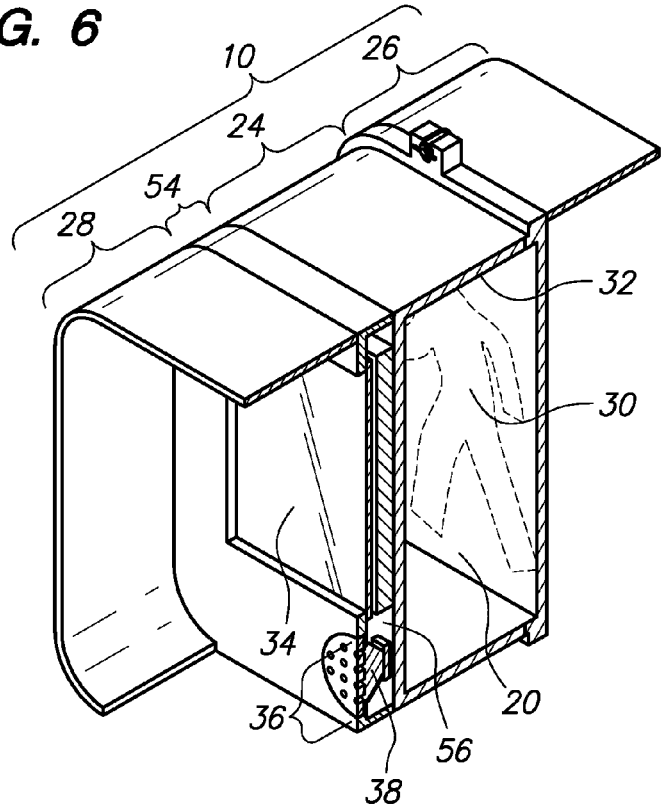
FIG. 6 is a cross sectional view of the pedestrian signal shown in FIG. 4.

Referring now to FIG. 5, an exploded view of the pedestrian signal 10 shown in FIGS. 3 and 4 is shown. The pedestrian signal housing 24 may be a traditional pedestrian signal housing. Preferably, the pedestrian signal housing 24 is one that has already been approved by the governmental agencies designated by the government to ensure that public pedestrian signal housing is safe. For example, the California Transportation Department or the Department of Highway and Transportation, Federal Highway Administration (FHWA), National Highway Traffic Safety Administration (NHTSA), Department of Transportation (DOT) for each of the fifty (50) states, all D.O.T.s for North America, South America, continents of Europe, Asia, Africa and Australia. By way of example and not limitation, the pedestrian signal housing may be the 12", 16" housings or other size dictated by the relevant D.O.T. sold by Traffic Control Device companies. The video display screen 20 is mounted to the pedestrian side of the pedestrian signal housing 24 by way of a face plate 54. No modifications are made to the preapproved pedestrian signal housing 24. As such, no further approvals are needed by the California Transportation Department or the Department of Highway and Transportation despite the addition of the video display screen 20 and/or the speaker 38, by way of the faceplate 54. Preferably, the face plate 54 has an outer periphery that matches the outer periphery of the pedestrian signal housing 24. Moreover, the face plate 54 may have a recess 56 (see FIG. 6) so that the video display screen 20 is covered entirely by the face plate 54 and the face plate 54 is flush with the pedestrian signal housing 24, as shown in FIG. 6. The face plate 54 may be attached to the pedestrian signal housing 24 by way of fastener (e.g., screw) 58 to mount the video display screen 20 to the pedestrian side of the pedestrian signal housing 24. The face plate 54 may additionally have speaker apertures 36 for allowing audible signals to be projected to the pedestrians 12. The tunnel visor 28 may be attached to the face plate 54 or alternatively to the pedestrian signal housing 24 (not shown).

Referring now to FIG. 6, a cross sectional view of the housing 24 and tunnel visors 26, 28 are shown. The housing 24 may have an outer shell 32. The face plate 54 may have a transparent window 34 and the perforated speaker aperture 36 for projecting audible sound to the pedestrian 12. The transparent window 34 may be scratch resistant and weather resistant to withstand weather and vandalism. A speaker 38 may be disposed behind the speaker apertures 36 behind the faceplate 54. The speaker aperture 36 may be covered with a water impermeable membrane. Additionally, the video display screen 20 may be disposed behind the transparent window 34 within the recess 56. The pedestrian signal 10 may display information to pedestrians 12 by showing video, still photos, etc. on the video display screen 20. Additionally, an audible signal may be projected out of the speaker 38 through the speaker apertures 36 that is synched to the visual images displayed on the video display screen 20. The housing 24 may additionally contain a lightable stop indicia 22 and a lightable walk indicia 30 viewable on the street side of the housing 24.

Figure 6A:
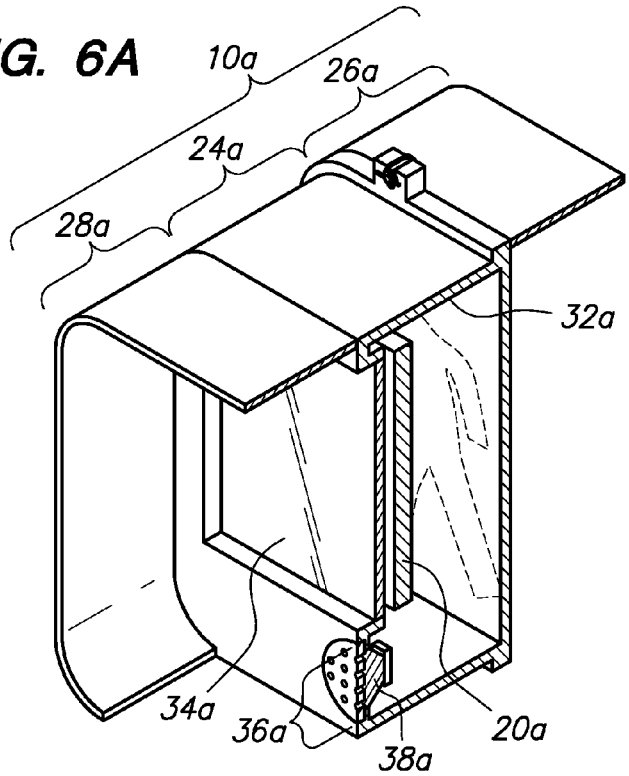
FIG. 6A is an alternate embodiment of the pedestrian signal shown in FIG. 6.

Referring now to FIG. 6A, an alternate embodiment of the pedestrian signal 10*a* is shown. The outer shell 32*a* of the pedestrian signal housing 24*a* may be modified. In particular, the pedestrian side of the pedestrian signal housing 24*a* may integrate the face plate 54 into the shell 32*a* of the pedestrian signal housing 24*a*. To this end, the pedestrian side of the shell 32*a* may have an aperture and be covered by window 34*a*. The window 34*a* may be weather resistant and scratch resistant to withstand environmental conditions and vandalism. Moreover, the pedestrian side of the shell 32*a* may have speaker apertures 36*a* which may be covered with a fluid impermeable layer to prevent entry of water into the shell 32*a*. Speaker 38*a* may be mounted behind the speaker aperture 36*a*. Video display screen 20*a* may be mounted behind the window 34*a* and attached to the shell 32*a* such as by way of screws, nuts and bolts, adhesive, brackets, etc. Tunnel visors 26*a*, 28*a* are attached to the exterior of the pedestrian signal housing 24*a*.

Figure 7:
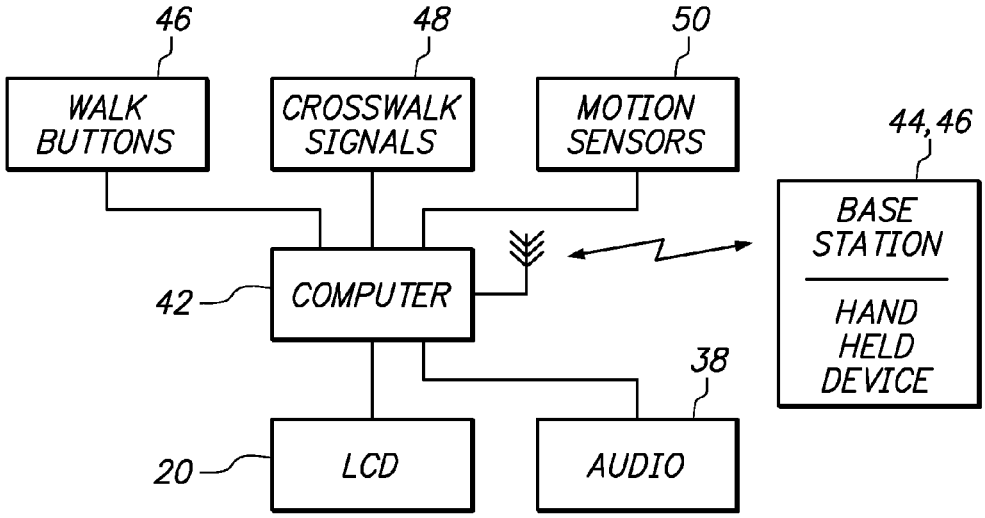
FIG. 7 is a schematic for electronically controlling the video display screen and speaker of the pedestrian signal.

Referring now to FIG. 7, the video display screen 20 and the speaker 38 may be in electrical communication with a computer 42. By way of example and not limitation, the video display screen 20 may be an liquid crystal display screen, a plasma screen, a series of light emitting diodes, etc. The computer 42 may be a microprocessor, a DVD player, etc. The computer 42 may be disposed within the shell 32. Alternatively, the computer 42 may be located elsewhere such as in an electronic control box located at the first or second sidewalks 16, 18. The information displayed on the video display screen 20 and the audio signals projected from the speaker 38 may be wirelessly (e.g., cell phone, radio frequency, etc.) downloaded to the computer 42 from a base station 44 or handheld device 46. Alternatively, the information displayed on the video display screen 20 and the audible signals from the speaker 38 may be provided by inserting a DVD, CD or computer readable medium into the computer (e.g., a DVD player or computer drive). It is also contemplated that the computer 42 can be in communication with the internet for receiving the information and the audio signals. The internet communications may be accomplished by wired connection, wirelessly, through cell phone signals, radio frequency, etc. At the appropriate time, the computer sends the electrical signals to the video display screen 20 and speaker to display the information on the video display screen 20 and project audible signals to the speaker 38.

The computer 42 may begin displaying information on the video display screen 20 and project audible signals through the speaker 38 based on one or more input signals 46, 48, 50. By way of example and not limitation, referring back to FIG. 1, when a pedestrian 12 walks up to a crosswalk 52, the pedestrian 12 may be presented with a walk button 46 on the first sidewalk 16. When the pedestrian 12 pushes the walk button 46*a*, such action signals to the computer 42 that the pedestrian 12 is waiting to cross the pathway 14 from the first sidewalk 16 to the second sidewalk 18. At this time, the computer 42 may display information on the video display screen 20 of the first pedestrian signal 10*a* and/or project audible sound through the speaker 38 of the first pedestrian signal 10*a*. Alternatively, the computer 42 may begin displaying information on the video display screen 20 and/or projecting an audible signal through the speaker 38 of the first pedestrian signal 10*a* when the pedestrian 12 triggers motion sensor 50*a* or when the cross walk signals 48 (see FIG. 6) indicate that the lightable stop indicia 22 of the pedestrian signal 10*b* on the other side of the pathway 14 is lighted.

Moreover, a combination of the signals 46, 48, 50 may trigger the computer 42 to display information on the video display screen 20 and project audible signals through the speaker 38. By way of example and not limitation, the computer 42 may display information on the video display screen 20 and project audible signals through the speaker 38 of the pedestrian signal 10*a* only when the crosswalk signals 48 (see FIG. 7) indicate activation of the lightable stop indicia 22 of the pedestrian signal 10*b* on the other side of the pathway 14 and triggering of either the push button 46*a* and/or the motion sensors 50*a* on the first sidewalk 16. Shortly before or when the pedestrian signal 10*b* on the other side of the pathway 14 activates the lightable walk indicia 30, the computer 42 may cease displaying information on the video display screen 20 and cease sending audio signals to the speaker 38 of the pedestrian signal 10*a*. The reason is to redirect the person's attention to cross traffic on the pathway 14. The person may now focus his/her attention in safely crossing the pathway 14. Conversely, the computer 42 may display information on the video display screen 20 and project audible signals through the speaker 38 on the pedestrian signal 10*b* only when the crosswalk signals 48 indicate activation of the lightable stop indicia 22 of the pedestrian signal 10*a* on the other side of the pathway 14 and triggering of either the push button 46*b* and/or the motion sensors 50*b* on the second sidewalk 18. Similarly, shortly before or when the pedestrian signal 10*a* on the other side of the pathway 14 activates the lightable walk indicia 30, the computer 42 may cease displaying information on the video display screen 20 and cease sending audio signals to the speaker 38 of the pedestrian signal 10*b*. These steps are for safety reasons and allowing the pedestrian to focus on safely crossing the pathway 14. As such, a safe and efficient means of relaying information to a captive audience (i.e., pedestrian waiting to cross a crosswalk) may be relayed to the pedestrian.

The information displayed on the video display screen 20 may relay local information as described in relation to FIG. 2. In this manner, the information relayed to the pedestrians 12 may relate to various services in the local area such that advertisers can provide information about local services that might be of need to pedestrians 12 at that time. It is also contemplated that the information may be related to traffic information, global news information, directions, advertisements, etc.

The pedestrian signals 10*a, b* described herein provide the ability to retrofit existing pedestrian signals already installed at street corners and crosswalks by way of the face plate 54. As such, the pedestrian signal housing 24 does not need to go through another set of approvals by the appropriate governmental agency. Rather, the video display screen 20 and the face plate 54 can be retrofitted onto existing pedestrian signals already installed at street corners and crosswalks. Moreover, the video display screen 20 and face plate 54 may be sold and mounted to preapproved pedestrian signal housings as a retrofit kit. When the pedestrian signal housings are installed at the street corners, crosswalks and roads, the face plate 54 and video display screens 20 kit is mounted to the pedestrian side of the pedestrian signal housing 24. Governmental entities (e.g., cities, states, etc.) may also utilize the system described herein to generate additional revenues. In particular, the information displayed on the video display screens 20 may be advertisements paid by businesses providing local services (e.g., one hour photo services, restaurant services, etc.) or larger entities. The sponsors of the advertisements may pay the governmental entity a fee to show their advertisements.

The pedestrian signal housings with video display screen 20 and speaker 38 may be installed at various crosswalks throughout a city, state or the country. Based on the demographic of the type of people crossing the crosswalk (e.g., income level, location, age, etc.), advertisers may purchase advertising time at one or more selective crosswalks to relay information to their target market. By way of example and not limitation, the crosswalks located adjacent to Disneyland in California may be populated with families with children. Businesses that sell products and services to families may purchase advertising time at these crosswalks to display information and provide relevant content to their target market (e.g., families). Local businesses may also purchase advertising time at crosswalks adjacent their business to draw clientele from pedestrians needing their services and products. Additional revenues may be generated by the creation of the advertisement. For example, local businesses may not have sufficient funds to hire an independent advertising agency to create visual and/or audible advertisements. Governmental entities and/or third party businesses working in conjunction with the governmental entities may provide these add-on services to increase revenues.

The above description is given by way of example, and not limitation. Given the above disclosure, one skilled in the art could devise variations that are within the scope and spirit of the invention disclosed herein, including various ways of programming computer 42. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pedestrian traffic control system disposed between first and second sidewalks, the system comprising:

a first pedestrian light signal disposed at the first sidewalk for directing pedestrian traffic from the second sidewalk to the first sidewalk and for displaying information to pedestrians waiting at the first sidewalk to cross over to the second sidewalk, the first traditional pedestrian light signal comprising:

a first housing defining a street side and an opposed pedestrian side, the street side having a lightable walk indicia and a lightable stop indicia, the lightable walk indicia being lighted for a first period of time to direct pedestrians to cross from the second sidewalk to the first sidewalk, the lightable stop indicia being lighted for a second period of time to direct pedestrians to wait at the second sidewalk until safe;

a first video screen disposed on the pedestrian side of the first housing to display information to pedestrians waiting at the first sidewalk to cross over to the second sidewalk;

a second pedestrian light signal disposed at the second sidewalk for directing pedestrian traffic from the first sidewalk to the second sidewalk and for displaying information to pedestrians waiting at the second sidewalk to cross over to the first sidewalk, the second traditional pedestrian light signal comprising:

a second housing defining a street side and an opposed pedestrian side, the street side having a lightable walk indicia and a lightable stop indicia, the lightable walk indicia being lighted for a third period of time to direct pedestrians to cross from the first sidewalk to the second sidewalk, the lightable stop indicia being lighted for a fourth period of time to direct pedestrians waiting at the first sidewalk until safe;

a second video screen disposed on the pedestrian side of the second housing to display information to pedestrians waiting at the second sidewalk while waiting to cross over to the first sidewalk.

2. The pedestrian traffic control system of claim 1 further comprising a first speaker disposed within the first housing for projecting audio in sync with video displayed on the first video screen to pedestrians waiting at the first sidewalk.

3. The pedestrian traffic control system of claim 1 further comprising a computer wherein the computer syncs the information displayed on the first video screen to the lightable stop indicia of the second pedestrian signal, and the computer syncs the information displayed on the second video screen to the lightable stop indicia of the first pedestrian signal.

4. The pedestrian traffic control system of claim 1 further comprising a first sensor disposed at the first sidewalk and in communication with the first video screen, a second sensor disposed at the second sidewalk and in communication with the second video screen and a computer controlling the first and second video screens, wherein the computer controls the information to be displayed on the first video screen so as to be initiated when a first pedestrian triggers the first sensor, and the computer controls the information to be displayed on the second video screen so as to be initiated when a second pedestrian triggers the second sensor.

5. The pedestrian traffic control system of claim 4 wherein the first and second sensors are a push button switch or a motion sensor.

6. The pedestrian traffic control system of claim 4 wherein the computer controls the information displayed on the first video screen so as to terminate before or at the time the lightable stop indicia of the second pedestrian light signal is deactivated, and the computer controls the information displayed on the second video screen so as to terminate before or at the time the lightable stop indicia of the first pedestrian light signal is deactivated.

7. The pedestrian traffic control system of claim 1 wherein the information is local advertisement, directions or safety information.

8. The pedestrian traffic control system of claim 1 wherein the first and second pedestrian traffic signals further comprise first and second tunnel visors attached to the pedestrian side of the first and second pedestrian traffic signals.

9. A method of safely displaying information to pedestrians waiting to cross a pathway disposed between first and second sidewalks, the method comprising the steps of:

activating a lightable stop indicia of a second pedestrian light signal disposed at the second sidewalk;

upon activation of the lightable stop indicia of the second pedestrian light signal, activating a first video screen of a first pedestrian light signal disposed at the first sidewalk so that pedestrians at the first sidewalk waiting to cross the pathway to the second sidewalk can view information displayed on the first video screen;

activating a lightable stop indicia of a first pedestrian light signal disposed at the first sidewalk;

upon activation of the lightable stop indicia of the first pedestrian light signal, activating a second video screen of a second pedestrian light signal disposed at the second sidewalk so that pedestrians at the second sidewalk waiting to cross the pathway to the first sidewalk can view information displayed on the second video screen.

10. The method of claim 9 further comprising the steps of:

synching deactivation of the lightable stop indicia of the second pedestrian signal and the first video screen;

synching deactivation of the lightable stop indicia of the first pedestrian signal and the second video screen.

11. The method of claim 10 wherein the synching steps comprise the steps of:

deactivating the lightable stop indicia of the second pedestrian signal;

before or upon deactivating the lightable stop indicia of the second pedestrian signal, deactivating the first video screen;

deactivating the lightable stop indicia of the first pedestrian signal;

before or upon deactivating the lightable stop indicia of the first pedestrian signal, deactivating the second video screen.

12. The method of claim 9 wherein the activating the first and second video screens comprise the steps of:

triggering a first push button or a first motion sensor associated with the first pedestrian signal;

upon triggering the first push button or first motion sensor, activating the first video screen;

triggering a second push button or a second motion sensor associated with the second pedestrian signal;

upon triggering the second push button or second motion sensor, activating the second video screen.

* * * * *